US005908206A

United States Patent [19]

LoPresti, Jr.

[11] Patent Number: 5,908,206

[45] Date of Patent: Jun. 1, 1999

[54] SKI POLE STRAP AND SKI AND BOOT CARRIER SYSTEM

[76] Inventor: Vincent J. LoPresti, Jr., 967 Parkview Ct., Carson City, Nev. 89705

[21] Appl. No.: 08/782,043

[22] Filed: Jan. 10, 1997

[51] Int. Cl.[6] ..... A63C 11/00; A63C 11/22; A45F 3/14; A41D 19/00

[52] U.S. Cl. ..... 280/814; 280/816; 280/820; 280/822; 224/250; 2/160

[58] Field of Search ..... 280/816, 819, 280/820, 821, 822, 814; 224/202, 205, 250, 257, 258; 2/160, 161

[56] References Cited

U.S. PATENT DOCUMENTS

| | | | |
|---|---|---|---|
| D. 305,961 | 2/1990 | Cobb | D3/105 |
| 3,259,284 | 7/1966 | Olson | 224/5 |
| 3,297,333 | 1/1967 | Schwedt et al. | 280/11.37 |
| 4,234,202 | 11/1980 | Loffelholz | 280/820 |
| 4,593,933 | 6/1986 | Nunno | 280/812 |
| 4,653,121 | 3/1987 | Kassal et al. | 2/160 |
| 4,728,123 | 3/1988 | Kassal et al. | 280/822 |
| 4,760,944 | 8/1988 | Hughes | 224/205 |
| 4,790,462 | 12/1988 | Kawaguchi | 224/250 |
| 4,867,359 | 9/1989 | Donovan | 224/202 |
| 5,110,154 | 5/1992 | Street | 280/822 |
| 5,123,674 | 6/1992 | Bagneres et al. | 280/821 |
| 5,294,152 | 3/1994 | Jacobs | 280/821 |
| 5,306,046 | 4/1994 | Stanley | 280/819 |
| 5,328,205 | 7/1994 | Bacharach | 280/822 |
| 5,386,591 | 2/1995 | Canan | 2/160 |
| 5,425,485 | 6/1995 | Carlo | 224/258 |
| 5,427,291 | 6/1995 | Smith | 224/250 |
| 5,435,273 | 7/1995 | Landis et al. | 119/795 |
| 5,450,991 | 9/1995 | Neading | 224/151 |
| 5,678,730 | 10/1997 | Fabek et al. | 222/78 |

FOREIGN PATENT DOCUMENTS 0 173 396 12/1952 Australia .

*Primary Examiner*—Lanna Mai
*Assistant Examiner*—Bridget Avery
*Attorney, Agent, or Firm*—Kane, Dalsimer, Sullivan, Kurucz, Levy, Eisele and Richard, LLP

[57] ABSTRACT

Ski pole straps separate from wrist straps are adapted to be releasably coupled by fastening means such as buckles or Velcro fasteners. The ski pole straps are adapted to be fastened to releasably attach the ski poles together. The wrist straps are adapted to be releasably attached to facilitate carrying ski boots and skis together with ski poles by hand. A sling strap is adapted to be fastened to the wrist straps to facilitate carrying ski boots and skis together with ski poles over the shoulder.

16 Claims, 2 Drawing Sheets

SKI POLE STRAP AND SKI AND BOOT CARRIER SYSTEM

BACKGROUND OF THE INVENTION

This invention relates generally to ski equipment, and, more particularly, to a novel system for attaching a ski pole to the hand of a skier which may then be advantageously converted to other applications while skiing and before and after skiing.

For safety reasons, ski resorts require that ski poles be released from the skier's wrists prior to riding a ski lift. Today it is conventional to have wrist straps with loops permanently attached to ski poles which straps are removed from the skier's wrists at some point before actually being seated on the ski lift. Normally, it is difficult, awkward and time consuming to remove the hand from the loop of each of the wrist straps, especially while wearing heavy gloves or mittens.

A number of ski carriers have been proposed, some of which also facilitate carrying poles as well. In this regard, the skis are placed in a tandem back-to-back position with straps placed around the skis and the poles are placed in loops. The difficulty with these systems is the requirement that the carriers must be carried on the person of that skier during skiing.

Similarly, boot carrying straps are a separate carrier system which will also be carried by the skier during skiing.

SUMMARY OF THE INVENTION

A principal object of the present invention is to provide a single carrier system for ski poles, skis and boots.

Another object is or provide a carrier system of the foregoing type with improved quick disconnect wrist straps for ski poles that facilitate the fast release or removal of ski poles from the wrist of a skier and coupling of the poles together before entering a chair lift, and the attachment of ski poles to the skier's wrist prior to skiing.

A further object is to provide a carrier system of the foregoing type that also facilitates carrying skis and ski poles.

A still further object is to provide a carrier system of the foregoing type that has the capability of serving as a ski boot carrier.

Other objects and advantages will become apparent from the following detailed description which is to be taken in conjunction with the accompanying drawings.

DETAILED DESCRIPTION

Figure 5:
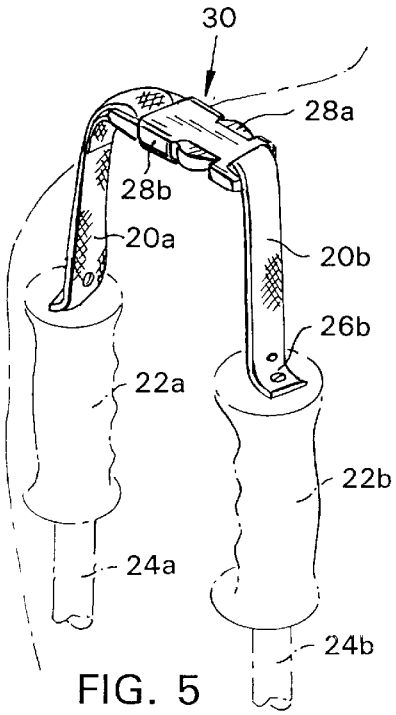
FIG. 5 is a perspective view of the ski pole straps of FIGS. 2A and 2B releasably connected by the formed buckle.

Referring initially to FIGS. 1A, 1B, 2A and 2B, a ski pole strap 20*a* is adapted to be secured to the handle 22*a* of ski pole 24*a* by any suitable means such as a pin or screw 26*a* or any other commercially available fastening system. The free end of strap 20*a* has suitably secured thereto a male member 28*a* of a releasable buckle. Similarly, a ski pole strap 20*b* is secured to the handle 22*b* of the other ski pole 24*b* by pin 26*b*. The free end of strap 20*b* has suitably secured thereto a female member 28*b* of the releasable buckle. When it is desired to secure the ski poles together, as for example, when entering a chair lift, the male member 28*a* is inserted in the female member 28*a* to form a releasable buckle 30 (see FIG. 5).

Figure 1A:
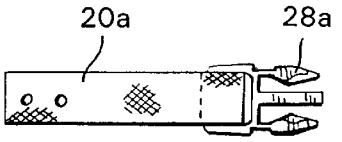
FIG. 1A is a plan view of a ski pole strap having a male member of a buckle.
Figure 1B:
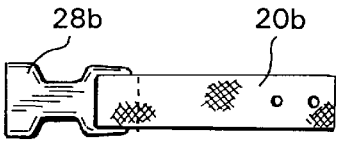
FIG. 1B is a plan view of a ski pole strap having a female member of a buckle.
Figure 2A:
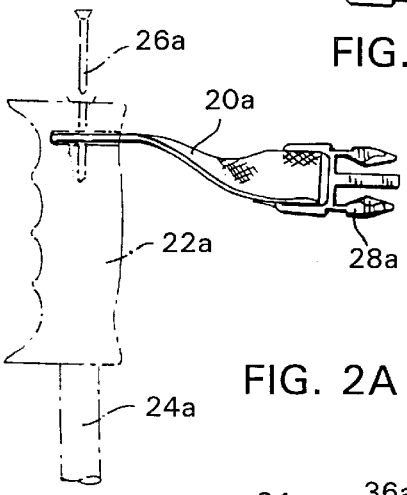
FIG. 2A is a side elevational view of the ski pole strap of FIG. 1A with an associated ski pole shown in phantom.
Figure 2B:
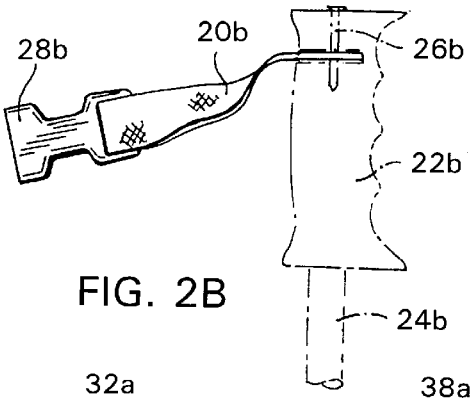
FIG. 2B is a side elevational view of the ski pole strap of FIG. 1B with an associated ski pole shown in phantom.
Figure 3A:
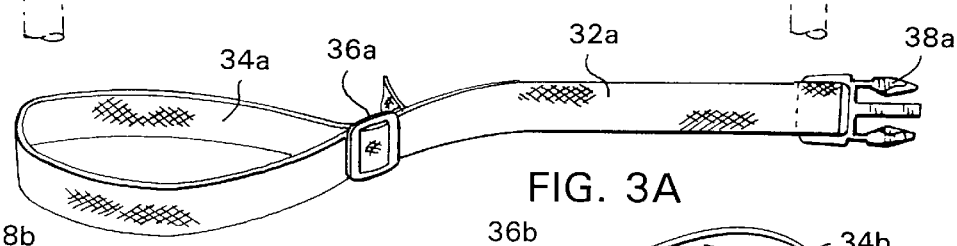
FIG. 3A is a perspective view of a wrist strap having a male member of a buckle.
Figure 3B:
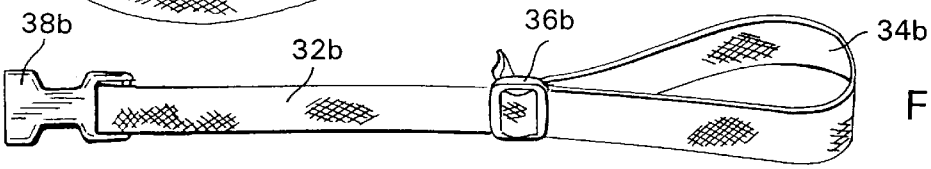
FIG. 3B is a perspective view of a wrist strap having a female member of a buckle.
Figure 6:
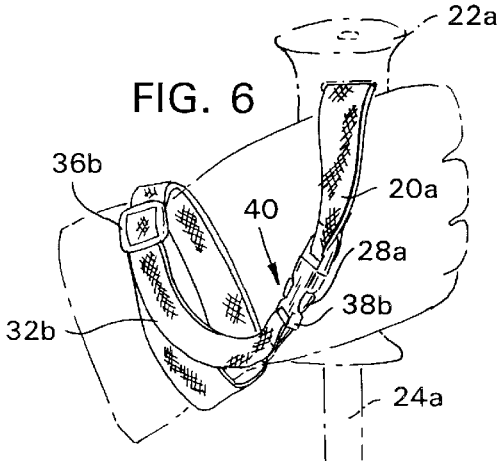
FIG. 6 is a perspective view of the pole strap of FIG. 2A or 2B releasably connected to a wrist strap of FIG. 3A or 3B by the formed buckle.

Referring now to FIGS. 3A and 3B, one wrist strap 32*a* is formed with an adjustable loop 34*a* by a slidable buckle 36*a*. The free end of the strap 32*a* has suitably secured thereto male member 38*a* of a releasable buckle. The other wrist strap 32*b* is formed with an adjustable loop 34*b* by a slidable buckle 36*b*. The free end of the strap 32*b* has suitably secured thereto female member 38*b* of the releasable buckle. Of course, the skier's hands are inserted through loops 34*a*, 34*b* and the buckles 36*a*, 36*b* are moved to adjust the size of the loops and also to tighten the straps 32*a*, 32*b* around the wrist of the skier. When it is desired to secure the wrist straps to the ski poles, male member 38*a* of wrist strap 32*a* is inserted into female member 28*b* of ski pole strap 20*b* to form a releasable buckle; and male member 28*a* of ski pole strap 20*a* is inserted into female member 38*b* of wrist strap 32*b* to form releasable buckle 40 (see FIG. 6). When it is desired to free the ski poles from the skier's wrists, as for example, when entering a chair lift, the buckles 40 are uncoupled.

Figure 4:
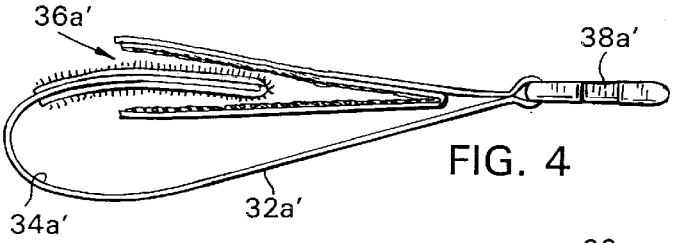
FIG. 4 is a side elevational view of another embodiment of a wrist strap.

In another embodiment of wrist strap 32*a*', shown in FIG. 4, a VELCRO hook and loop fastener 36*a*' may be employed to releasably secure the loop 34*a*' around the wrist of the skier.

Figure 7:
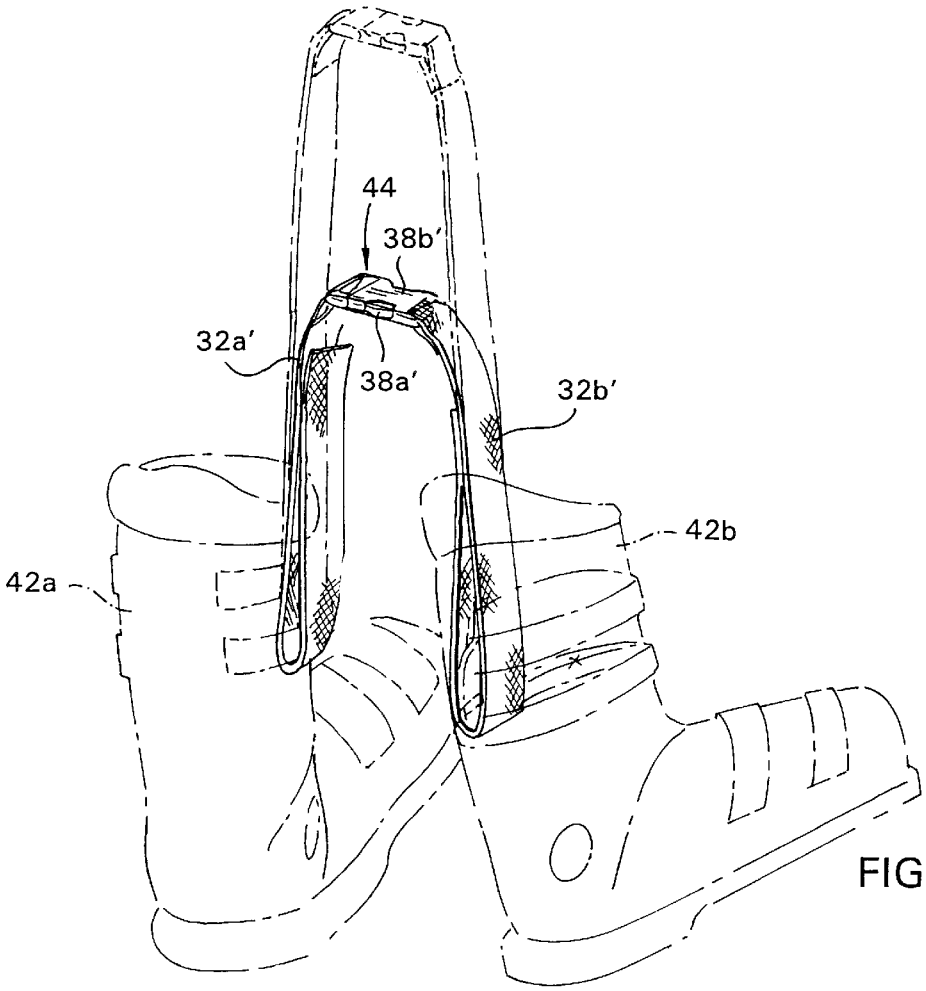
FIG. 7 is a perspective view of wrist straps connected by the formed buckle for facilitating the carrying of ski boots.
Figure 8:
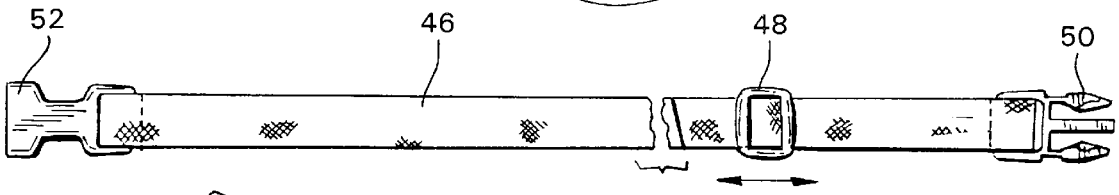
FIG. 8 is an optional adjustable belt having a buckle male member at one end and a buckle female member at the other end that could be deployed for purposes of carrying skis and ski poles.

Another important advantage of the carrier system of the present invention is the ability to employ the wrist strap as a carrier for ski boots. As shown in FIG. 7, wrist straps 32*a*', 32*b*' are looped around the upper buckle or buckles of the respective ski boots 42*a*, 42*b* and then the male member 38*a*' is inserted into the female member 38*b*' to form releasable buckle 44. The wrist straps may be shortened or lengthened by adjusting the respective Velcro fasteners to facilitate carrying the boots by hand or over the shoulder.

Figure 9:
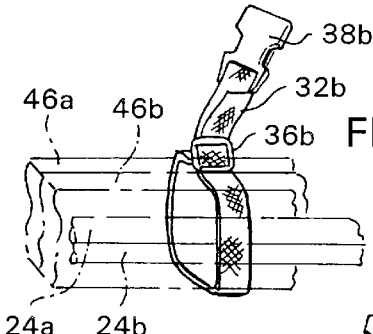
FIG. 9 is a fragmentary perspective view of wrist straps coupling skis and ski poles.
Figure 10:
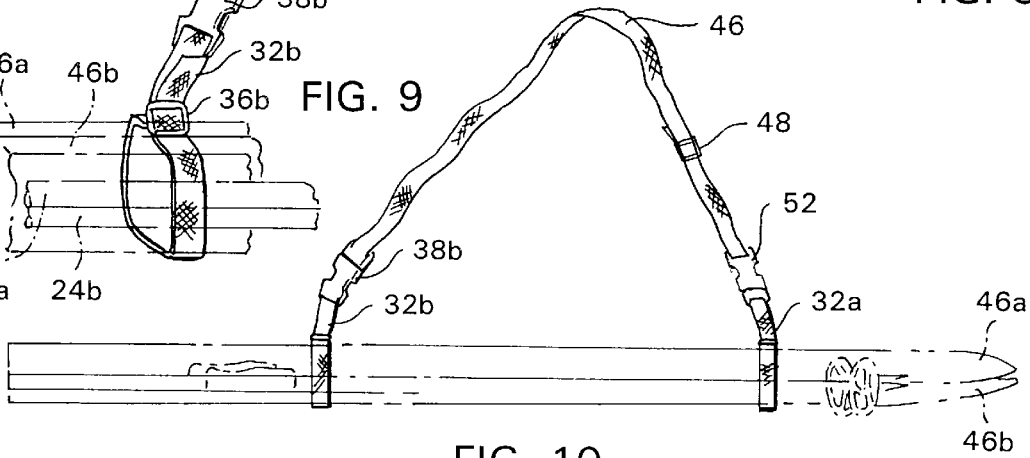
FIG. 10 is a side elevational view of wrist straps coupling the skis and ski poles and connected with the belt of FIG. 8 for facilitating the carrying of the skis and poles on a skier's shoulders.

When it is desired to utilize the carrier system of this invention to carry skis alone or together with the ski poles, reference is now made to FIGS. 9 and 10. Initially, the skis 46*a*, 46*b* and poles 24*a*, 24*b* are placed in the loops 34*a*, 34*b* of spaced wrist straps 32*a*, 32*b*. The straps 32*a*, 3*b* are tightened around the skis and poles by shifting the respective buckles 36*a*, 36*b*. When it is desired to simply carry by hand the skis and poles, the male member 38*a* is inserted into female member 38*b* to form buckle 44.

The present invention also envisions carrying the skis and poles over the shoulder. In this regard, a separate sling strap 46 is provided. This strap 46 may be adjustable in length by means of a movable buckle 48. At one end of the strap 46, is a suitably secured male buckle member 50 and at the other end is a suitably secured female buckle member 52. Male member 50 is inserted into female member 38*b* of the wrist strap 32*b* suitably secured about the skis and poles and male member 38*a* is inserted into female member 52 as shown in FIG. 10. The skis and poles are then capable of being carried by placing belt 41 over the shoulder.

As will be apparent, the sling strap 46 may be used to carry the ski boots 42*a* and 42*b* by coupling with the respective wrist straps 32*a*, 32*b*. Moreover, VELCRO hook and loop fasteners may also be utilized to couple strap 46 to the wrist straps.

Thus, the several aforementioned objects and advantages are most effectively attained. Although several somewhat preferred embodiments of the invention have been disclosed and described herein, it should be understood that this invention is in no sense limited thereby and its scope is to be determined by that of the appended claims.

What is claimed:

1. A ski pole and wrist strap combination comprising:

a first ski pole having a handle end;

a first ski pole strap connected with the handle end of the first ski pole and having a free end;

the first ski pole strap free end having a first fastening means;

a first wrist strap having a free end and an opposite end comprising first loop means at the opposite end forming a loop for embracing a first wrist of a skier and a second fastening means at the free end of the first wrist strap;

the first and second fastening means are adapted to be releasably coupled to releasably attach the first ski pole to the first wrist of the skier;

the first fastening means being so constructed and arranged to provide coupling means for permitting the pole to be releasably coupled to a complementary first fastening means of a second ski pole, for releasably coupling the ski poles to one another;

the second ski pole having a handle end;

second ski pole strap connected with the handle end of the second ski pole and having a free end;

the second ski pole strap free end having a complementary first fastening means;

a second wrist strap having a free end and an opposite end comprising a second loop means at the opposite end forming a loop for embracing a second wrist of the skier and a complimentary second fastening means at the free end of the second wrist strap;

the complementary first and second fastening means are adapted to be releasably coupled to releasably attach the second ski pole to the second wrist of the skier.

2. The invention is in accordance with claim 1 wherein means are provided for adjusting the size of the loop.

3. The invention is in accordance with claim 1 wherein the loop means included a hook and loop fastener means for adjusting the size of the loop.

4. The invention is in accordance with claim 1 wherein the first and second fastening means include a male member and a female member defining a releasable buckle whereby the male member is adapted to be inserted into the female member to attach the wrist strap to the ski pole strap and adapted to be uncoupled from the female member to free the wrist strap from the ski pole.

5. The invention is in accordance with claim 1, wherein another of said ski pole and wrist strap are provided, the first fastening means of one ski pole strap being a male buckle member and the first fastening means of the other ski pole strap being a female buckle member, and the second fastening means of one wrist strap being a male buckle member and the second fastening means of the other wrist strap being a female buckle member.

6. The invention is in accordance with claim 5 wherein the ski poles are adapted to be coupled with one another by inserting the male buckle member of the one ski pole strap into the female buckle member of the other ski pole strap to thereby provide a releasable buckle.

7. The invention is in accordance with claim 5 wherein the male buckle member of the one wrist strap is adapted to be inserted into the female buckle member of the other wrist strap to thereby provide a releasable buckle coupling the wrist straps together to provide a carrier system for ski boots whereby the loop means of the one wrist strap is adapted to loop around surfaces of one ski boot and the loop means of the other wrist strap is adapted to loop around surfaces of another ski boot whereby the boots may be carried by hand by grasping the wrist straps and carried over a shoulder by slinging the wrist straps over the shoulder.

8. The invention is in accordance with claim 7 wherein a sling strap has at one end a male buckle member and a female buckle member at the other end thereof, the male buckle member with the sling strap adapted to be inserted into the female buckle member of the other wrist strap and the male buckle member of the one wrist strap adapted to be inserted into the female buckle member of the sling strap whereby the sling strap may be placed on the shoulder for facilitating the carrying of the boots.

9. The invention is in accordance with claim 5 wherein the male buckle member of the one wrist strap is adapted to be inserted into the female buckle member of the other wrist strap to thereby provide a releasable buckle coupling the wrist straps together to provide a carrier system for skis and ski poles whereby the loop means of the one wrist strap is adapted to loop around the skis and ski poles and the loop means of the other wrist strap is adaptable to loop around the skis and ski poles, the wrist straps being spaced from one another on the skis and ski poles, whereby the skis and ski poles may be carried by hand by grasping the wrist straps.

10. The invention is in accordance with claim 9 wherein a sling strap has at one end a male buckle member and a female buckle member at the other end, the male buckle member with the sling strap adapted to be inserted into the female buckle member of the other wrist strap and the male buckle member of the one wrist strap adapted to be inserted into the female buckle member of the sling strap whereby the sling strap may be placed on the shoulder for facilitating the carrying of the skis and ski poles.

11. The invention is in accordance with claim 1 wherein another of said ski pole and wrist strap are provided, and the first and second fastening means defining hoop and loop fasteners.

12. The invention is in accordance with claim 9 wherein a sling strap has opposed ends and fastening means at each of such end and defining with the first and second fastening means hoop and loop fasteners.

13. The invention in accordance with claim 1 wherein the second fastening means at the free end of the first wrist strap is adapted to be releasably coupled to the complementary second fastening means at the free end of the second wrist strap to thereby provide a releasable fastening means coupling the wrist straps together to provide a carrier system for ski boots whereby the first loop means of the first wrist strap is adapted to loop around surfaces of a first ski boot and the second loop means of the second wrist strap is adapted to loop around the surfaces of a second ski boot whereby the boots may be carried by hand by grasping the wrist straps and carried over a shoulder by slinging the wrist straps over the shoulder.

14. The inventors in accordance with claim 13 wherein a sling strap has at one end a complementary third fastening means and a complimentary fourth fastening means at the other end thereof, the complimentary third fastening means of the sling strap adapted to be coupled with complimentary second fastening means of the second wrist strap and the second fastening means of the first wrist strap adapted to be coupled with the complementary third fastening means of the sling strap whereby the sling strap may be placed on the shoulder for facilitating the carrying of the boots.

15. The invention in accordance with claim 1 wherein the second fastening means of the first wrist strap is adapted to be coupled with the complementary second fastening means of the second wrist strap to thereby provide a releasable fastening means coupling the wrist straps together to provide a carrier system for skis and ski poles whereby the first loop of the first wrist strap is adapted to loop around the skis and ski poles and the second loop of the second wrist strap is adapted to loop around the skis and ski poles, the wrist straps being spaced from one another on the skis and ski poles, whereby the skis and ski pole may be carried by hand by grasping the wrist straps.

16. The inventors in accordance with claim 15 wherein a sling strap has at one end a complementary third fastening means and a complimentary fourth fastening means at the other end thereof, the complimentary third fastening means of the sling strap adapted to be coupled with complimentary second fastening means of the second wrist strap and the second fastening means of the first wrist strap adapted to be coupled with the complementary third fastening means of the sling strap whereby the sling strap may be placed on the shoulder for facilitating the carrying of the skis and ski poles.

* * * * *